US005284425A

United States Patent [19]

Holtermann et al.

[11] Patent Number: 5,284,425

[45] Date of Patent: Feb. 8, 1994

[54] FLUID METERING PUMP

[75] Inventors: Ludwig K. Holtermann, Old Saybrook; Jodie D. Haupt, North Guilford; Samuel R. Hanford, Ivoryton, all of Conn.

[73] Assignee: The Lee Company, Westbrook, Conn.

[21] Appl. No.: 978,346

[22] Filed: Nov. 18, 1992

[51] Int. Cl.[5] ..... F04B 45/00

[52] U.S. Cl. ..... 417/395; 417/413 R

[58] Field of Search ..... 417/395, 413 R

[56] References Cited

U.S. PATENT DOCUMENTS

| | | | |
|---|---|---|---|
| 3,701,614 | 10/1972 | Guidicelli | 417/413 R |
| 4,143,998 | 3/1979 | O'Connor | 417/413 R |
| 4,631,008 | 12/1986 | Stenner | 417/477 |
| 4,636,149 | 1/1987 | Brown | 417/413 R |
| 4,832,582 | 5/1989 | Buffet | 417/413 R |

FOREIGN PATENT DOCUMENTS

| | | | |
|---|---|---|---|
| 585298 | 9/1933 | Fed. Rep. of Germany | 417/413 |
| 2439964 | 9/1975 | Fed. Rep. of Germany | 417/413 |
| 8707683 | 12/1987 | PCT Int'l Appl. | 417/413 |

*Primary Examiner*—Richard A. Bertsch

*Assistant Examiner*—Roland G. McAndrews, Jr.

*Attorney, Agent, or Firm*—Philip J. Lee

[57] ABSTRACT

A pump for dispensing accurately measured amounts of fluid has a one way check valve in the flow path on the upstream side of a pump chamber and a one way check valve in the flow path at the downstream side of the pump chamber which is of variable internal volume. A flow passage provides fluid communication from the upstream check valve to the pump chamber and enters the pump chamber by a centrally located opening that is surrounded by a valve seat. One wall of the pump chamber is a flexible and elastic diaphragm that is attached to the plunger portion of a solenoid actuator. The plunger and diaphragm are biased by a spring acting upon the plunger such that, in the absence of excitation of the solenoid coil, the diaphragm is biased against a valve seat, preventing flow through the pump. All components exposed to the fluid media are formed of chemically inert, non-corrosive substances and the pump can be sized to accurately dispense fluids in increments of as little as 10 microliters, representing the volume of fluid that passes through the pump in one cycle of the solenoid actuator.

15 Claims, 5 Drawing Sheets

FLUID METERING PUMP

BACKGROUND OF THE INVENTION

A. Field of invention

The present invention relates generally to devices for pumping fluids and more particularly to a new and improved pump for dispensing controlled amounts of chemically aggressive or sensitive fluids.

B. Description of Related art

Dispensing controlled amounts of fluids requires a means for precisely controlling the flow through the dispensing device. In particular, it is important to insure that such a dispensing system does not leak or weep when the pump is not in active operation. As exemplified by U.S. Pat. No. 4,832,582 to Buffett, it is known to provide a fluid dispensing pump having one way inlet and outlet valves separated by a chamber of variable volume. One wall of the Buffett pump consists of an oscillating diaphragm which causes the chamber volume to alternately increase and decrease. While the Buffett pump provides a flow of fluid at a relatively constant rate, the integral valves of the Buffett pump only impede flow through the valve by the resilience of the one way duck bill valves at the inlet and outlet ports which provide only slight resistance to opening. Since the factors impeding flow in the Buffett pump would also directly and adversely affect the pump's efficiency, it is to be expected that these factors would be minimized to increase efficiency and conversely decrease resistance to flow. Accordingly, a relatively small positive pressure differential across the Buffett pump would be expected to cause flow to proceed through the pump independent of the operation of the pump. For this reason, conventional pumps such as Buffett are frequently used in applications in which a positive pressure drop across the pump is not anticipated. An example of the limitations of use of such pumps is shown by the placement of the fluid reservoir below the Buffet pump. Such pumps could not be utilized in those applications wherein the fluid reservoir is most conveniently located above the pump as this would create a pressure drop across the pump which could be sufficient to cause the pump to leak when not in operation.

Some other type pumps such as vane or screw types as well may, when new, provide a measure of integral means of flow control by virtue of either positive blockage or impedance of flow; however, as wear occurs at the junction of the vanes or blades and the housing and other parts that move against or past one another, a tight seal is difficult and leakage may commence even in the conventional pumps that are designed to block flow by integral means. Wear of moving parts is particularly important in devices designed for use with chemically sensitive or aggressive fluids because the acceptable materials are limited and are not selected on the basis of wear resistance characteristics. In other systems, flow through the system is controlled by means of an external shut off valve at either the inlet or outlet of the system. In such systems, although the pump mechanism would otherwise leak when not activated, flow is nevertheless blocked by a shut off valve operated in coordination with the pump. A system using both a pump and a separate shut off valve is cumbersome, particularly in applications requiring controlled dispensing of minute amounts or multiple dispensers in a small area. The separate shut off valve may represent an inefficient use of material as a result of the duplication of the flow control function. In addition, the coordination of operation between the valve and pump requires a common control or other means of ensuring simultaneous operation, and the breakdown or other failure of the operation control would be expected to cause the system to experience potentially damaging stress.

SUMMARY OF THE INVENTION

The device of the present invention in its preferred embodiment is a pump designed to dispense very small amounts of fluid. Specifically, while other sizes and volumes are possible, the preferred embodiment is capable of dispensing volumes as small as approximately 10 microliters per cycle and to provide integral means for blocking of flow through the pump when the pump is not in operation. The pump comprises a general housing forming an inlet flow passage into which the fluid media passes from an inlet port that is in communication with a fluid source. A check valve is positioned in the inlet flow passageway between the inlet port and a central pump chamber and allows flow into the pump chamber. One wall of the central pump chamber consists of a molded diaphragm that is formed of an elastomeric material and molded to securely fit to the head of a solenoid plunger on the side opposite the pump chamber. An outlet passage similarly communicates with the pump chamber and is formed within the housing. A check second valve is secured between the outlet passage and an outlet port preventing flow into the pump chamber from the outlet port while allowing flow out of the pump chamber and into the outlet port, thence exiting the pump. The housing forms one wall of the pump chamber. The pump chamber wall is configured in a shape similar to that of a shallow round dish, having a circular, partial spherical surface. The diaphragm surface facing the pump chamber is essentially flat and the diaphragm surface on the opposite, plunger side, has substantial reinforcing material surrounding the plunger head. The diameter of the pump chamber wall formed by the housing is only slightly greater than the diameter of the thickened portion of the diaphragm and upon de-energization of the solenoid, the plunger rests against the pump chamber wall and thereby reduces the volume of the pump chamber to a minimal amount. The surface of the diaphragm facing the pump chamber is flat and covers the plunger head. The housing wall surrounding the opening of the inlet passage to the pump chamber is raised to provide an annular valve seat that is coaxial with the plunger. The plunger is biased by a spring means toward the valve seat and forces the diaphragm against the valve seat to block flow through the pump except when the plunger is retracted. The plunger is received in a solenoid coil which, when suitably energized, retracts the plunger and the attached diaphragm away from the valve seat and pump chamber wall. Retraction of the plunger and diaphragm expands the internal volume of the pump chamber and allows flow across the valve seat into the pump chamber. The retraction of the plunger causes a temporary negative pressure within the pump chamber relative to the system pressure thereby drawing fluid into the pump chamber by temporarily raising the differential across the inlet check valve. Operation of the solenoid by means of a square wave causes cycles of alternating plunger retraction and plunger extension. During the de-energizing portion of the cycle, the volume of the pump chamber is rapidly decreased as the spring biased plunger forces the diaphragm to move toward the valve seat and pump chamber wall. It is expected that there will exist an exit flow commencement point after the commencement of and during the diaphragm return portion of the operating cycle when the pressure of the fluid within the pump chamber is raised to a minimum level sufficient to cause an exit differential across the outlet check valve sufficient to overcome the resistance to flow presented by the outlet check valve. It is also expected that there will exist an inlet flow ending point after the commencement of and during the de-energizing portion of the operating cycle when the pressure of the fluid within the pump chamber is raised to a sufficient level to cause a back pressure sufficient to reduce the pressure differential across the inlet check valve below that needed to overcome the resistance to flow presented by the inlet check valve. If there exists a significant period of time between the exit flow commencement point and the inlet flow ending point, the undesirable circumstance of flow through the device can occur at rates that are determined by facts, e.g. system pressure, that are independent of the operation of the device. In the pump of the present invention, a number of features serve to minimize or eliminate any period of free flow. The diaphragm is relatively large in relation to the size of the pump chamber and the size of the inlet and outlet flow passages combines with the dish shaped chamber wall to cause the volume of the pump chamber to increase rapidly in response to a relatively short plunger stroke. In addition, limiting the energization portion of the cycle to end before the exit flow pressure is attained, minimizes the possibility of a period of free flow. The length of any free flow period is dependent upon the action of the spring rather than the retraction time of the solenoid, provided the retraction speed is adequate to cause an immediate negative pressure relative to the system pressure. The diaphragm is installed so as to be subject to slight radial tension when the plunger is half way between full retraction and full extension. When the plunger is fully retracted, the diaphragm is additionally tensioned and exerts a closing force upon the plunger in addition to the spring force, and when the plunger is fully extended, the diaphragm is again tensioned and exerts an opening force upon the plunger is addition to the solenoid force, thereby providing additional plunger speed at the transitions from extending to retracting and from retracting to extending which additionally reduces the possibility for a free flow period. Since the selection of the plunger spring and timing of the retraction time can minimize the free flow period, the volume of fluid put through the pump per cycle can be relatively precisely predetermined within limits of accuracy set by the range of system conditions that are expected.

The principal aim of the present invention is to provide a new and improved fluid metering pump which meets the foregoing requirements and which will block flow through the pump by integral means.

Another and further object and aim of the present invention is to provide a new and improved fluid metering pump which dispenses a predetermined amount of fluid per cycle.

Another and further object and aim of the present invention is to provide a new and improved fluid metering pump which will be economical to manufacture and install in miniature sizes.

Other objects and advantages of the invention will become apparent from the Description of the Preferred Embodiments and the Drawings and will be in part pointed out in more detail hereinafter.

The invention consists of the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
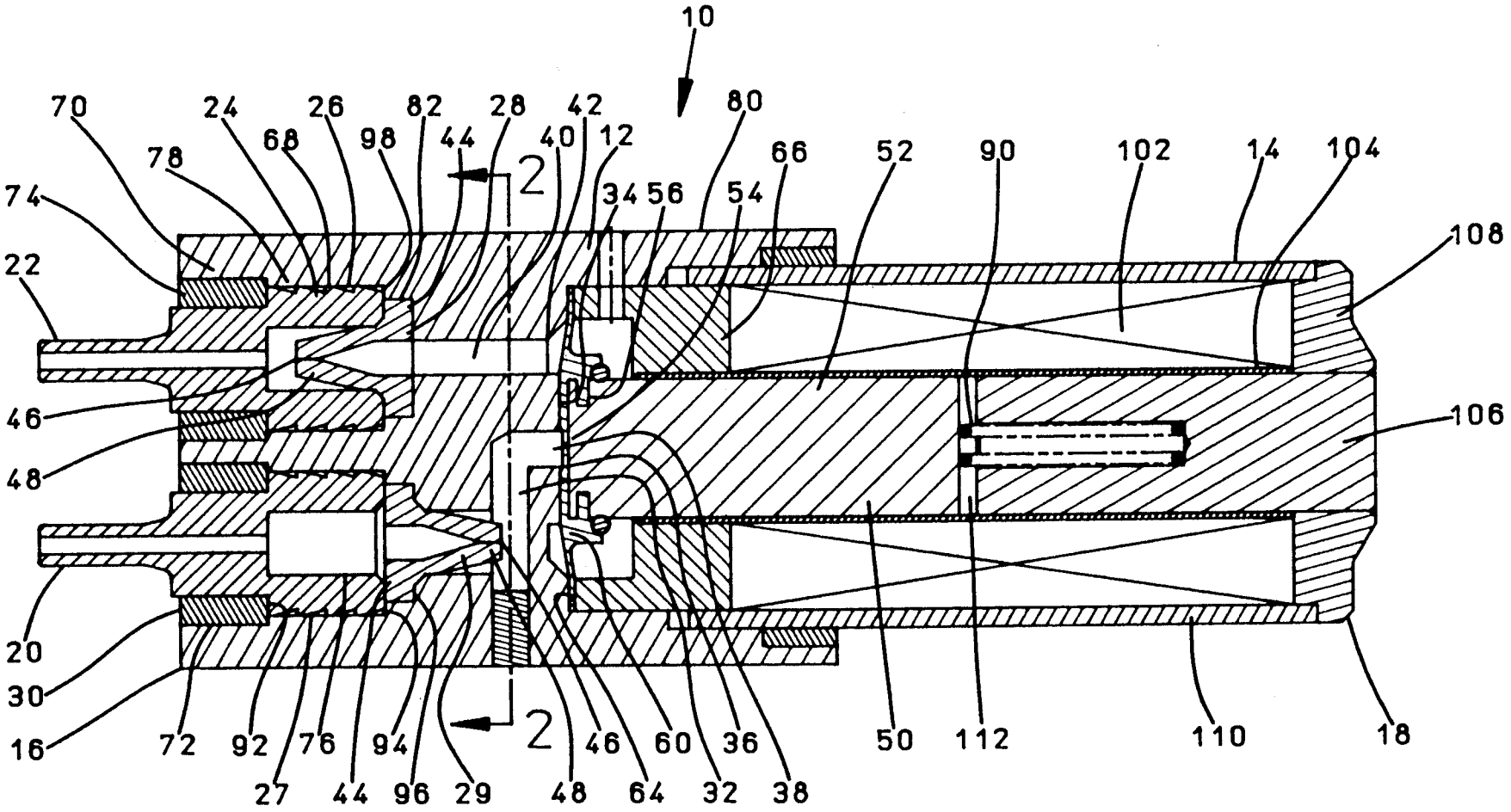
FIG. 1 is a longitudinal sectional view of a preferred embodiment of a fluid metering pump in accordance with the present invention taken along lines 1—1 shown in FIG. 2, showing the pump when closed to flow.
Figure 2:
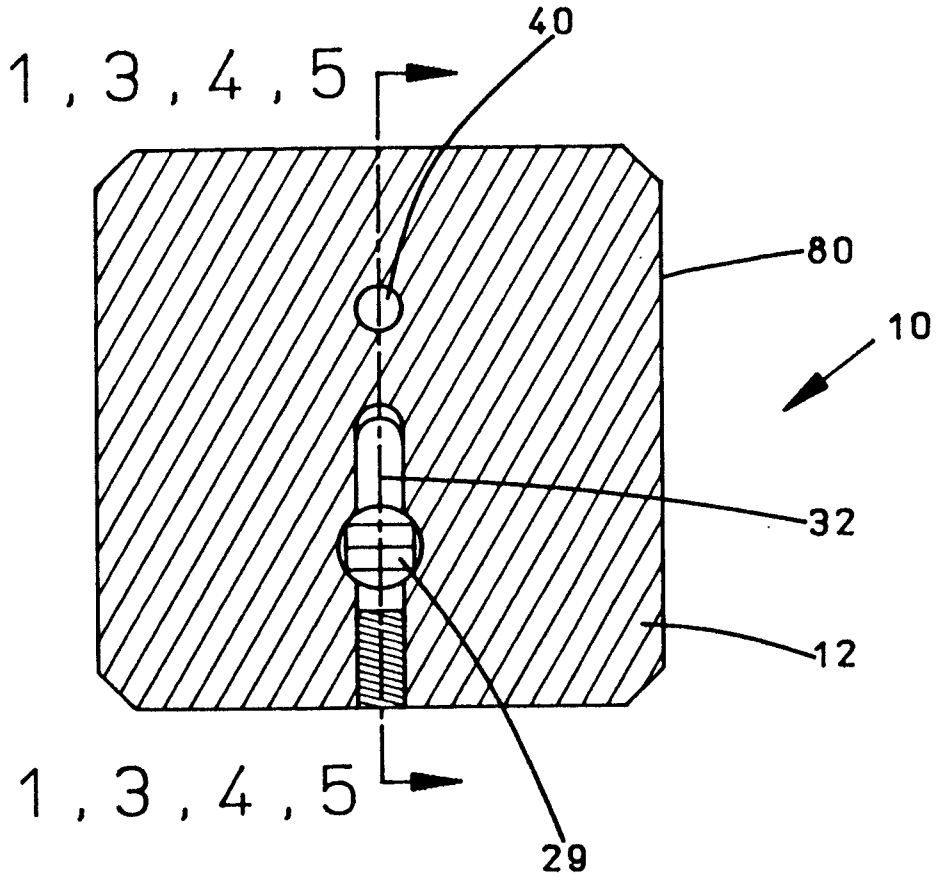
FIG. 2 is a cross sectional view of a preferred embodiment of a fluid metering pump in accordance with the present invention taken along lines 2—2 shown in FIG. 1.
Figure 3:
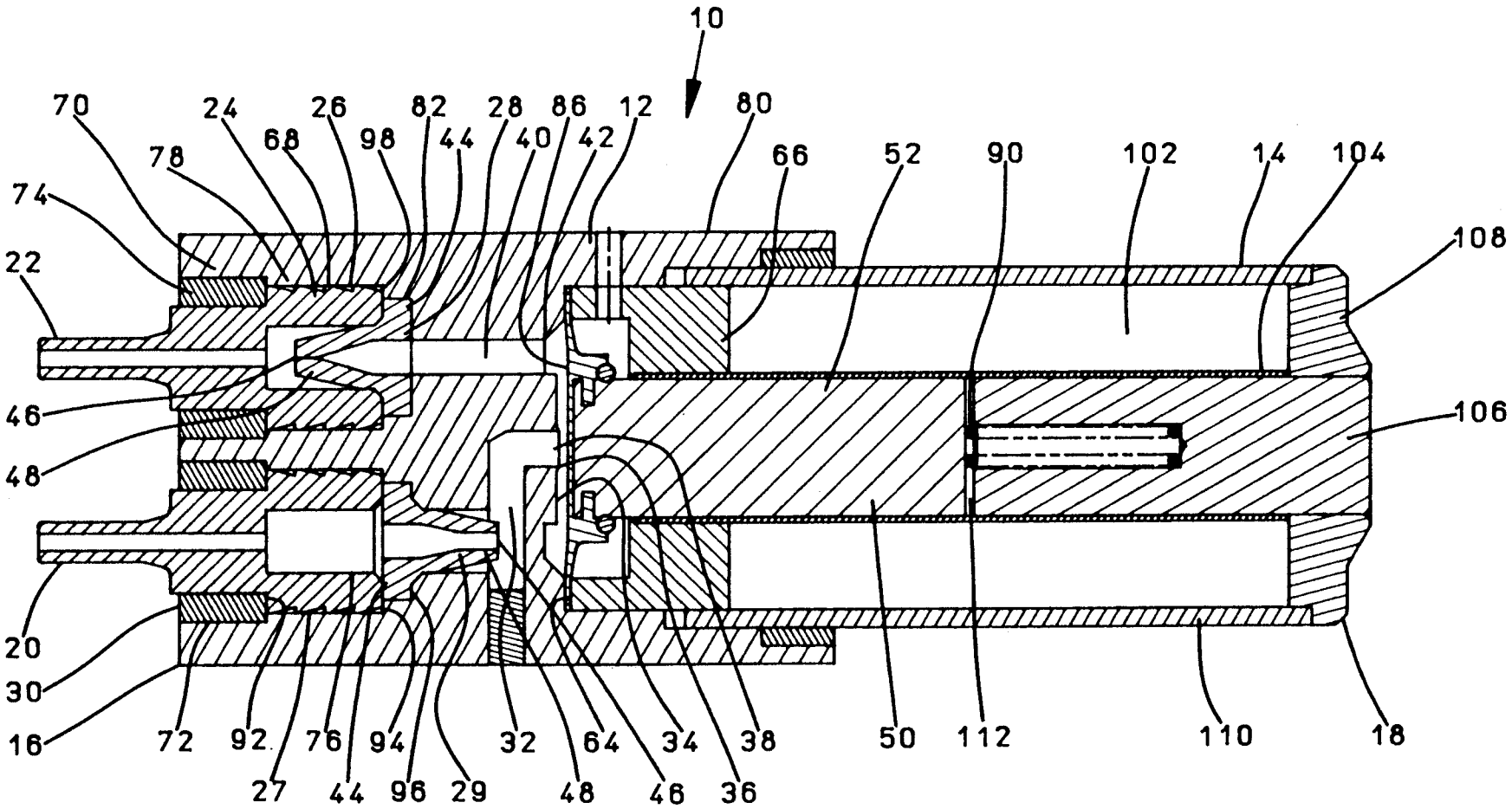
FIG. 3 is a longitudinal sectional view of a preferred embodiment of a fluid metering pump in accordance with the present invention taken along lines 3—3 shown in FIG. 2, showing the input phase of the pump.
Figure 4:
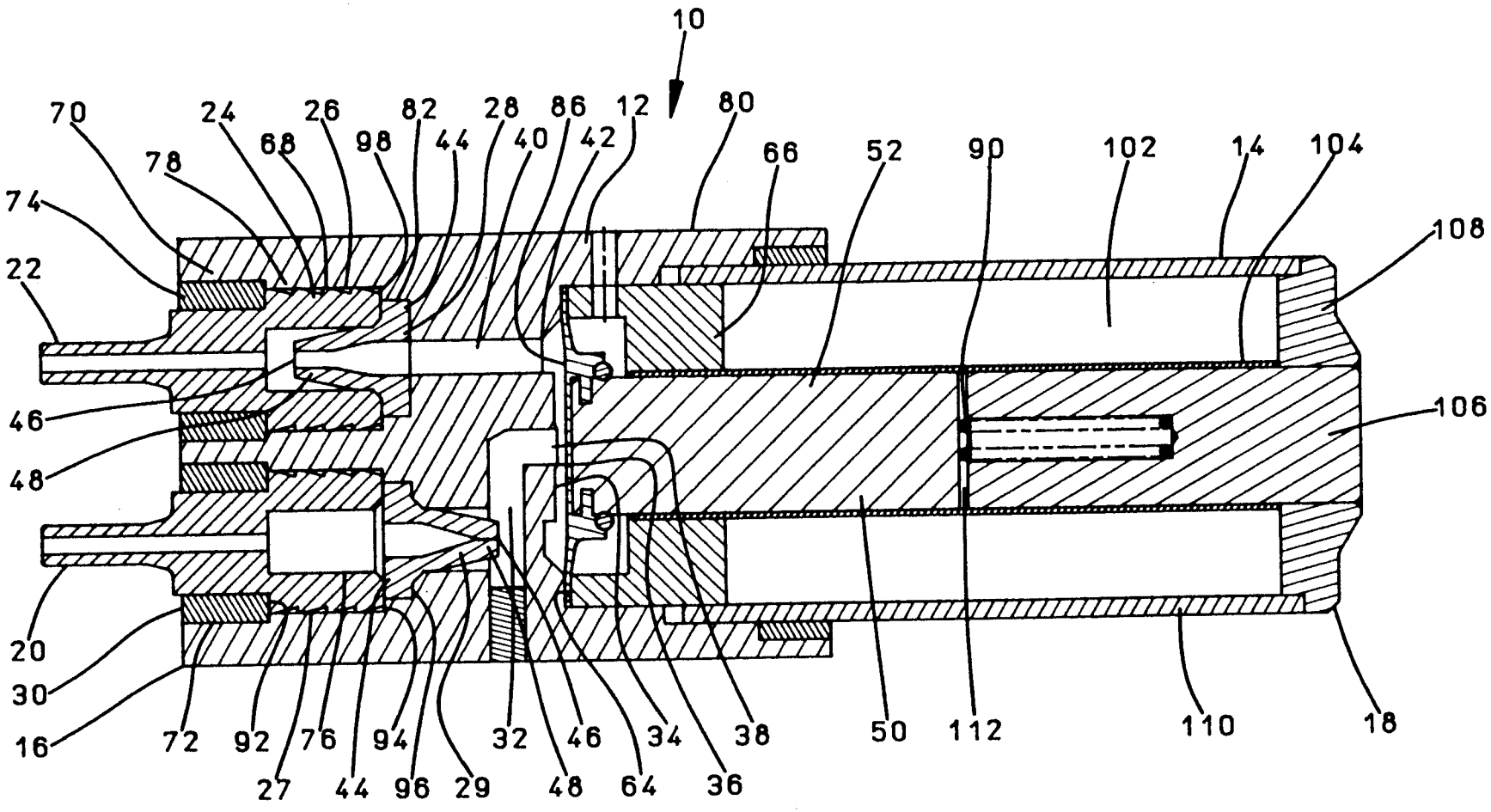
FIG. 4 is a longitudinal sectional view of a preferred embodiment of a fluid metering pump in accordance with the present invention taken along lines 4-4 shown in FIG. 2, showing the output phase of the pump.
Figure 5:
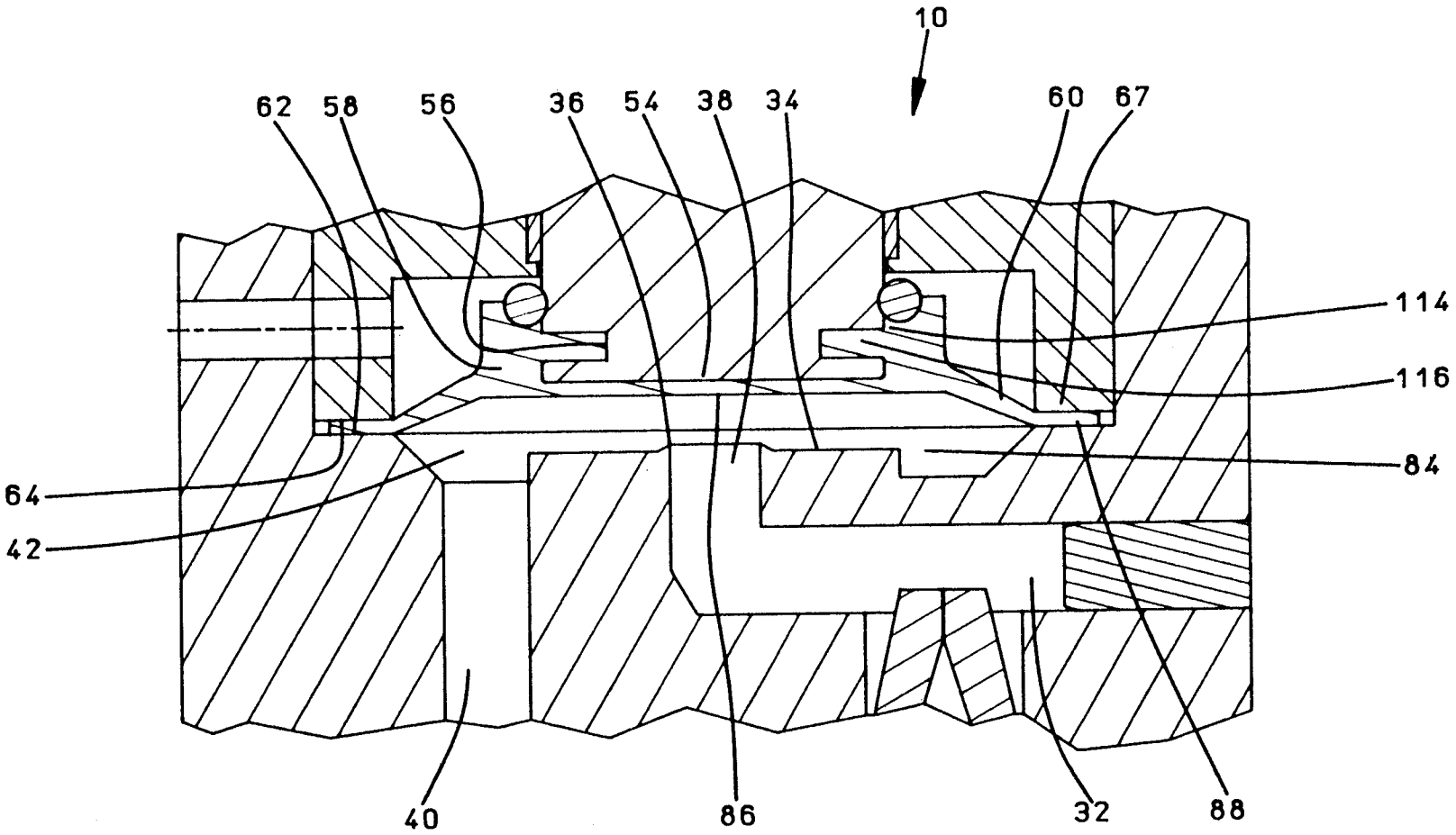
FIG. 5 is an enlarged partial longitudinal sectional view of a preferred embodiment of a fluid metering pump in accordance with the present invention taken along lines 5—5 shown in FIG. 2, showing the detail of the pump chamber portion the pump, with plunger retracted.

With reference to the drawings wherein like numerals represent like parts throughout the Figures, a fluid metering pump in accordance with the present invention is generally designated by numeral 10 in FIG. 1. Pump 10 is shown comprising a housing 12 and a solenoid assembly 14. The housing 12 has a square outer surface 80, a port end 16 and a solenoid end 18. The solenoid end 18 is adapted to receive the solenoid assembly 14. The port end 16 of housing 12 is adapted to receive an inlet port member 20 and an outlet port member 22.

For economy and ease of manufacture and assembly in the illustrated preferred embodiment, inlet port member 20 and outlet port member 22 are formed individually as separate pieces and are identical in shape being generally tubular each having an inner end 98 and a thickened wall section 24 adjacent to inner end 98 and adapted for secure and permanent insertion into either of two stepped, cylindrical sockets 26 and 27 formed within the housing 12. The socket 27 receives the inlet port member 20 and is identical to the socket 26 which receives outlet port member 22. The axis of sockets 26 and 27 are parallel to the axis of pump 10 and sockets 26 and 27 extend from port end 16 into housing 12 axially toward solenoid assembly 14 and have an area 70 of greatest internal diameter immediately adjacent to port end 16, an area 82 of least internal diameter at the end closest to solenoid end 18 and an area 78 of intermediate diameter axially intermediate between areas 70 and 82. The inside surfaces of areas 70, 82 and 78 are cylindrical and coaxial forming shoulders 92, 94 and 96 between the respective adjacent areas. Shoulder 94 is axially intermediate between areas 78 and 82 and provides a stop for the inner end 98 of the port members 20 and 22.

The insertion of port members 20 and 22 is performed after two identical check valves 29 and 28 are placed into sockets 26 and 27. In the illustrated preferred embodiment, check valves 28 and 29 are identical for ease and economy of manufacturing and are of the "duck bill" type generally comprising an annular rim 44 for secure location and two flexible flaps 48 that axially protrude from the rim 44 and are angled radially toward each other. The flaps 48 surround a closeable orifice 46 that is opened when the flaps 48 are separated by the force of the pressure of the fluid media being greater on the side opposite the flaps 48. The resilient flaps 48 are forced together thereby closing the orifice 46 by back pressure as well as the resilience of the material of flaps 48 and are opened by a pressure differential in the direction in which the flaps 48 protrude from rim 44 thereby causing flow to proceed in only one direction. Shoulder 96 forms the inner end of socket 26 and provides a restraint for the annular rim 44 of check valve 28 which is restrained between the inner end 98 of the port member 22 and shoulder 96, the axial thickness of rim 44 being slightly greater than the axial length of socket section 82 separating shoulders 96 and 94. Valve 29 is similarly restrained by inlet port member 20. Upon the port members 20 and 22 being pressed into sockets 26 and 27, the check valve rims 44 are compressed to provide a seal for the reduced diameter bore 82. The valve 29 that is secured by inlet port member 20 is oriented with the flaps 48 protruding away from inlet port member 20 and the valve 28 that is secured by outlet port member 22 is oriented with the flaps 48 protruding toward outlet port member 22. The orientation of valves 28 and 29 restricts flow by allowing flow only into pump 10 through inlet port member 20 and out of pump 10 through outlet port member 22.

The thick walled section 24 of port members 20 and 22 comprises a section 68 having an outer surface with a series of annular retaining ridges and another section 72 of reduced external diameter, the ridged section 68 being farther toward inner end 98 than section 72. The individual ridges of section 68 each have a first annular surface that extends radially outward at an angle that is approximately normal to the axis of the port member and a second annular surface which slopes radially inward toward the inner end 98 such that section 68 serves to provide retention of the port members 20 and 22 in housing 12 and upon the press fit of the port members 20 and 22 into sockets 26 and 27, the contact of the sections 68 with the inside wall of sockets 26 and 27 provide a series of line contact seals. The reduced outside diameter section 72 is located at the opening of sockets 26 and 27 at port end 16 in the immediate vicinity of increased internal diameter section 70 of sockets 26 and 27, and is of equal axial length. An annular gap 30 is formed between the decreased outside diameter section 72 of the port members 20 and 22 and the increased internal diameter of socket 26 and 27 providing an annular chamber 74 for receiving epoxy or other plastic or other substances suitable for cementing port members 20 and 22 into secure connection to housing 12. The inlet and outlet port members 20 and 22 include an area of increased internal diameter 76 adjacent to inner end 98 which on the outlet port number 22 allows room for the flaps 48 of check valve 28.

An inlet flow passage 32 is formed within housing 12 providing fluid communication from the inlet port number 20 to a pump chamber 84 formed by and between a diaphragm 60 and a pump chamber wall 34 formed by housing 12. Immediately downstream of the shoulder 96 securing the check valve 29 secured by the inlet port member 20, the inlet flow passage 32 is enlarged to provide room for the protrusion of check valve flaps 48. An outlet flow passage 40 is formed within housing 12 providing fluid communication from pump chamber 84 to the outlet port member 22. Pump chamber wall 34 is of a generally flat dish shape and in the preferred embodiment is generally symmetric about the axis of pump 10 with the exception of the location of an opening 42 in the pump chamber wall 34 through which outlet flow passage 40 communicates with pump chamber 84. The central portion of the pump chamber wall 34 is generally uniformly recessed toward the port end 16 of pump 10 and the radially outer edge of wall 34 comprises a annular, flat surface 62 that is normal to the axis of pump 10. The downstream end of the inlet flow passage 32 ends with an opening 38 in the pump chamber wall 34. In the illustrated preferred embodiment, the opening 38 of inlet passage 32 is annular and is surrounded by a raised section of pump chamber wall 34 forming a valve seat 36. In the illustrated preferred embodiment of pump 10, valve seat 36 and opening 38 are coaxial with the housing 12 and solenoid assembly 14 and opening 42 is somewhat offset from the axis of housing 12.

Solenoid assembly 14 includes a generally rod shaped plunger 52 and a stator assembly which comprises a plunger stop 106 of substantially the same radial diameter as plunger 52 and shaped as a solid cylindrical rod. Plunger 52 and plunger stop 106 are aligned serially along and are coaxial with the axis of pump 10 The stator assembly further comprises a wire coil 102 that is wound around a bobbin assembly formed by an annular plunger guide 66 and a flux washer 108 that are joined by a central tubular guide member 104 that has a central bore 112 with an internal diameter of approximately the same dimension as the outside diameter of plunger stop 106 and slightly greater diameter than plunger 52. Plunger stop 106 is received within guide member 104 and both the guide member 104 and the stop 106 are fixedly secured to flux washer 108. Plunger 52 is slidingly received within bore 112 between plunger stop 106 and pump chamber 84. A cylindrical solenoid shield 110 is coaxial with and radially outward of coil 102 and tube 104 and extends from plunger guide 66 to washer 108. One end of solenoid shield 110 overlaps and securely receives the radially outer surface of plunger guide 66 and is overlapped by and secured to the end of housing 12 that is closest to the solenoid end 18, thereby joining the housing 12 and the solenoid assembly 14. The other end of solenoid shield 110 is secured to the washer 108. Solenoid shield 110, coil 102, guide member 104, plunger 52, and plunger stop 106 are generally symmetric about the same axis and are arranged with the shield 110 as the radially outermost member while the plunger 52, and plunger stop 106 are the radially innermost members. It will be appreciated that the shield 110, flux washer 108, plunger stop 106, and plunger 52 are all formed of magnetically permeable material, while guide member 104 is formed of a relatively non-magnetic material. Plunger 52 comprises a flat plunger head 54 at one end which extends through the plunger guide 66 to engage a diaphragm 60 and a rod shaped armature section 50 that extends through the plunger guide 66 toward the plunger stop 106 and is slidingly received within the central bore 112 of guide member 104 which closely receive the outside diameter of the plunger armature section 50. Accordingly, upon electrical excitation of coil 102, a magnetic flux path completes a magnetic circuit across the air gap between the plunger stop 106 and the plunger 52 inducing an electromagnetic attraction between the plunger armature section 50 and the plunger stop 106. A spring 90 is compressed between the plunger 52 and a plunger stop 106 operates to bias the plunger 52 against the diaphragm 60 and thereby allow the pump 10 to remain closed in the absence of the activation of the solenoid coil 102. Plunger 52 is formed of appropriate materials such that the activation of the solenoid coil by causing electrical current to pass therethrough causes the plunger 52 to further compress spring 90 and slidingly retract thereby disengaging diaphragm 60 from the valve seat 36 and axially deforming diaphragm 60, opening the pump 10. Absent electrical activation of solenoid coil 102, spring 90 causes plunger head 54 to press the diaphragm 60 against the valve seat 36 to interrupt and block the flow of fluid through pump 10. Within tube 104, a spring 90 is received in a recess in plunger stop 106, and spring 90 extends past the end of plunger stop 106 to engage the end of plunger 52 and bias plunger 52 and plunger stop 106 in opposite directions.

An annular groove 56 is formed in the outer surface of plunger 52 close to, but axially spaced from, the plunger head 54. The plunger head 54 and groove 56 are received within a molded portion 58 of diaphragm 60. Diaphragm 60 is formed of an elastomeric material shaped generally in the shape of a flat circular disk having a flat pump chamber surface 86 on one side and on the other side includes a centrally located molded portion 58. The radially outer rim 88 of diaphragm 60 is flat on both sides and is secured between a flat annular surface 62 formed in housing 12 radially surrounding pump chamber wall 34 and an annular opposing shoulder 64 formed by the end of plunger guide member 66 that is closest to the diaphragm. The flat surface 86 of diaphragm 60 and surfaces 62 and 64 are oriented so as to lie in planes that are parallel to each other and normal to the axis of pump 10. In the illustrated preferred embodiment, housing 12 and the pump chamber wall 34 are dimensioned so that the axial distance between the plane of annular surface 62 and of valve seat 36 is slightly less than one-half of the allowed stroke of plunger 52. Upon assembly of pump 10, the radially outermost edge of diaphragm 60 is clamped between annular surface 62 and shoulder 64 of plunger guide member 66 without first applying any axially biasing force by spring 90 or otherwise. Therefore, surface 86 of diaphragm 60 is flat initially and in the plane of housing surface 62 when plunger 52 is approximately half way between the position of plunger 52 when coils 102 is excited and the position of plunger 52 when coil 102 is unexcited. The diameter of molded portion 58 of diaphragm 60 is only slightly less than the diameter of the recessed area of pump chamber wall 34 and the diameter of plunger 52 is only slightly less than the diameter of molded diaphragm portion 58, and as a result when plunger 52 is biased towards wall 34, substantially all of the pump chamber surface 86 of diaphragm 60 contacts the opposing surface of pump chamber wall 34 reducing the volume of the pump chamber 84 to a minimum. Molded section 58 includes a boot section 114 which securely and snugly receives plunger head 54 and includes an annular, inwardly protruding ring 116 that is located and dimensioned to fit into groove 56 to hold plunger head 54 within boot section 114. Plunger 52 is thus securely attached to diaphragm 60.

The diaphragm 60 is formed of a suitably chemically inert elastomeric material which in the preferred embodiment is a fluorocarbon rubber material. Alternative materials may be selected from other suitably inert materials provided their chemical characteristics are compatible with the desired fluid media and applications contemplated.

The pump housing 12 may be formed of a wide variety of alternative materials of suitable tensile strength and hardness provided they are chemically compatible with the flow medium. In the preferred embodiment, housing 12 is formed of polyetheretherketone (commonly referred to as "PEEK"). Other suitable materials would include that sold under the Trademark "Delrin" manufactured by E. I. du Pont de Nemours and Company, Wilmington, Delaware or polysulfone.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A pump comprising:

(a) An inlet port and an outlet port with a pump chamber there between, said pump chamber comprising a fixed wall and a diaphragm formed of elastomeric material;

(b) A first valve means for allowing a fluid media to enter the pump by flowing into the pump chamber from the inlet port while preventing the fluid media from exiting the pump by flowing from the pump chamber into the inlet port;

(c) A second valve means for allowing fluid media to exit the pump by flowing into the outlet port from the pump chamber and preventing fluid flow into the pump chamber from the outlet port;

(d) Means for alternately increasing and decreasing pressure within the pump chamber by moving the diaphragm alternately toward and away from the fixed wall of the pump chamber; and (e) an opening in the pump chamber wall communicating with the inlet port, which opening is surrounded by an annular valve seat raised above the surface of the pump chamber wall towards the interior of the pump chamber.

2. A pump according to claim 1, wherein the sealing engagement of the diaphragm with the valve seat prevents flow through the pump.

3. A pump according to claim 2, wherein the diaphragm has a flat surface comprising an interior surface of the pump chamber and a surface comprising means for attachment to the means for moving the diaphragm toward or away from the fixed pump chamber wall.

4. A pump according to claim 3, wherein the means for moving the diaphragm toward or away from the pump chamber wall comprises a solenoid assembly.

5. A pump according to claim 4, wherein the pump further comprises a housing member formed to receive the inlet and outlet ports, first and second valve means and is shaped to form the fixed pump chamber wall and the fluid passageway between the inlet and outlet ports and the pump chamber.

6. A pump according to claim 5 wherein the inlet outlet ports, first and second valve means, the housing and the diaphragm are formed of materials that are relatively chemically inert and resistant to chemically aggressive fluids.

7. A pump according to claim 6, wherein the inlet and outlet ports and pump housing are formed of polyetheretherketone.

8. A pump according to claim 7, wherein the first and second valve means and the diaphragm are formed of fluorocarbon rubber.

9. A pump according to claim 6, wherein the inlet and outlet ports and pump housing are formed of polysulfone.

10. A pump according to claim 9, wherein the first and second valve means and the diaphragm are formed of fluorocarbon rubber.

11. A pump comprising:

(a) An inlet port and an outlet port with a pump chamber there between, said pump chamber comprising a diaphragm formed of elastomeric material and a fixed wall formed by a housing that receives the inlet and outlet ports;

(b) a First valve means for allowing a fluid media to enter the pump by flowing into the pump chamber from the inlet port while preventing the fluid media from exiting the pump by flowing from the pump chamber into the inlet port;

(c) A second valve means for allowing fluid media to exit the pump by flowing into the outlet port from the pump chamber and preventing fluid flow into the pump chamber from the outlet port;

(d) Means for alternately increasing and decreasing pressure within the pump chamber by moving the diaphragm alternately toward and away from the fixed wall of the pump chamber;

(e) an opening in the pump chamber wall communicating with the inlet port is surrounded by an annular valve seat raised above the surface of the pump chamber wall towards the interior of the pump chamber; and (f) the valves, ports, diaphragm, and the housing all being formed of materials that are relatively chemically inert and resistant to chemically aggressive fluids.

12. A pump according to claim 11, wherein the sealing engagement of the diaphragm with the valve seat prevents flow through the pump.

13. A pump according to claim 12, wherein the means for moving the diaphragm toward or away from the pump chamber wall comprises a solenoid assembly.

14. A pump according to claim 13, wherein the inlet and outlet ports and pump housing are formed of polyetheretherketone.

15. A pump according to claim 13, wherein the inlet and outlet ports and pump housing are formed of polysulfone.

* * * * *